United States Patent [19]

Kira et al.

[11] Patent Number: 5,074,691

[45] Date of Patent: Dec. 24, 1991

[54] PRINTER WITH CONTINUOUS-PAGE SHEET FEEDER RELEASABLY ENGAGEABLE THEREWITH

[75] Inventors: Haruki Kira; Noriaki Kabeya, both of Nagoya, Japan

[73] Assignee: Brother Kogyo Kabushiki Kaisha, Japan

[21] Appl. No.: 570,535

[22] Filed: Aug. 21, 1990

[30] Foreign Application Priority Data

Sep. 22, 1989 [JP] Japan ..... 1-111352[U]

[51] Int. Cl.[5] ..... B41J 11/50

[52] U.S. Cl. ..... 400/605; 400/624; 400/629; 400/708

[58] Field of Search ..... 400/605, 624, 625, 626, 400/708, 708.1, 568, 569; 271/9

[56] References Cited

U.S. PATENT DOCUMENTS

| | | | |
|---|---|---|---|
| 4,152,771 | 5/1979 | Olander,Jr. et al. | 400/708 |
| 4,674,899 | 6/1987 | Kimura | 400/605 |
| 4,756,636 | 7/1988 | Maruyama et al. | 400/624 |
| 4,875,790 | 10/1989 | Karube et al. | 400/605 |
| 4,927,277 | 5/1990 | Niikawa | 400/605 |
| 4,929,104 | 5/1990 | Yokoi et al. | 400/708 |

FOREIGN PATENT DOCUMENTS

| | | | |
|---|---|---|---|
| 0145420 | 12/1978 | Japan | 400/708 |
| 0185670 | 10/1984 | Japan | 400/708 |
| 0192588 | 10/1984 | Japan | 400/708 |
| 0124271 | 7/1985 | Japan | 400/708 |
| 0217192 | 10/1985 | Japan | 400/708 |
| 0025862 | 2/1986 | Japan | 400/708 |
| 0158485 | 7/1986 | Japan | 400/708 |
| 0030073 | 2/1987 | Japan | 400/605 |
| 2197737 | 5/1988 | United Kingdom | 400/605 |

*Primary Examiner*—Eugene H. Eickholt
*Attorney, Agent, or Firm*—Oliff & Berridge

[57] ABSTRACT

A printer having a printing unit for printing on a sheet and a sheet feeding control section for controlling continuous or cut sheet feeding is disclosed. The sheet feeding control section performs sheet feeding of a predetermined amount after the data corresponding to one page has been printed by the printing unit. The sheet detecting section detects whether or not the printing sheet exists in the vicinity of the printing unit. If no printing sheet is det4ected in the vicinity of the printing unit, the printing control section determines that no continuous-page sheet feeder has been mounted. On the other hand, if the printing sheet is detected, the printing control section determines that the continuous-page sheet feeder has been mounted. If it is found that no continuous-page sheet feeder is mounted, the printing operation is stopped temporarily. If it is found that the continuous-page sheet feeder has been mounted, the printing operation is continued.

7 Claims, 4 Drawing Sheets

PRINTER WITH CONTINUOUS-PAGE SHEET FEEDER RELEASABLY ENGAGEABLE THEREWITH

BACKGROUND OF THE INVENTION

1. Field of the Invention

The present invention relates to a printer with which a continuous-page sheet feeder is releasably engageable, and particularly to a printer which is capable of detecting a state of releasable engagement with the continuous-page sheet feeder.

2. Description of the Prior Art

In a printing apparatus, i.e., a printer with which a continuous-page, sheet feeder, e.g., a tractor feeder is releasably engageable, it is necessary to change the printing operation of the printer according to the state of releasable engagement with the tractor feeder. If the printing is made on a cut sheet without employing the tractor feeder, there is used a typewriter, a printer or the like wherein the sheet is fed together with the rotation of a platen in such a state that the sheet is brought into contact with the platen serving as a sheet feeder provided inside the printer. If the tractor feeder is mounted and the printing is made on a continuous-page sheet in the typewriter, the printer or the like referred to above, the sheet is released from being brought into contact with the platen and hence the sheet is fed only by the tractor feeder.

This is because there are instances when the sheet feeding direction of the platen and that of the tractor feeder are not necessarily coincident with each other. In such a situation, a slight deviation can take place between the platen and the tractor feeder, resulting in wrinkling of the sheet or in tightening or clogging of the sheet.

In a typewriter, a printer or the like wherein the printing is made while moving a carriage with a printing head placed thereon in a transverse direction with respect to the sheet feeding direction, any position of the carriage at the time of insertion of the sheet gives rise to a problem in the case where the printing is made on the cut sheet without employing the tractor feeder. This is attributable to the fact that there is no device to guide the cut sheet along the sheet feeding direction on the platen and the sheet is inclined on the platen when the carriage is brought into contact with the left or right margin of the sheet.

To this end, when the cut sheet is printed without mounting the tractor feeder, the cut sheet is controlled such that it does not incline even when the carriage is brought into contact with the cut sheet and the carriage is also so controlled that it is located in the center of the width of the printing sheet in advance upon insertion of the sheet.

In this way, in the printer with which the tractor feeder is releasably engageable, it is necessary to change the printing operation of the printer, depending upon whether the tractor feeder is mounted on the printer or it is released therefrom. Thus, in the conventional printer, a switch or the like is provided on the body side of the printer in order to detect the state of the releasable engagement with the tractor feeder. When the tractor feeder is mounted on the printer, the switch or the like is turned on thereby to detect the state of the releasable engagement with the tractor feeder on the printer body.

Such a detection method is technically similar to that for detecting the state of the releasable engagement with a cut sheet feeder, which is of a type disclosed, e.g., in U.S. Pat. No. 4,756,636.

However, if a detecting member such as a switch, etc. is provided in the printer in order to detect the state of the releasable engagement with the tractor feeder in the above-described manner, a problem will arise in that the number of components used for the printer is increased and the manufacturing cost is raised because of the provision of the detecting member, a control means or the like.

SUMMARY OF THE INVENTION

With the foregoing problem in view, it is therefore an object of the present invention to provide a printer which is capable of detecting a state of a releasable engagement with a continuous-page sheet feeder without increasing the number of components and the manufacturing cost.

It is another object of the present invention to provide a printer with is capable of determining a state of a releasable engagement with a continuous-page sheet feeder without providing a switch for detecting whether or not the continuous-page sheet feeder exists.

It is a further object of the present invention to provide a printer which can perform an appropriate printing control based on the result of decision made as to whether or not a continuous-page sheet feeder is mounted.

According to one aspect of the present invention, there is provided a printer comprising a sheet feeder provided inside the body of the printer and for performing the sheet feeding, a printing means for printing on a sheet, a sheet feeding control means adapted to control the driving of a continuous-page sheet feeder mounted on the sheet feeder or the body of the printer and for further performing additional sheet feeding in a predetermined quantity after completion of the printing of data corresponding to one page, a sheet detecting means for detecting whether or not a printing sheet exists in the vicinity of the printing means, and a printing control means adapted to determine the fact that no continuous-page sheet feeder has been mounted on the sheet feeder or the body of the printer if it is found by the sheet detecting means that the printing sheet is absent after the sheet feeding has additionally been executed by the sheet feeding control means, thereby to temporarily stop the printing operation, and also adapted to judge the fact that the continuous-page sheet feeder has been mounted thereon if it is found by the sheet detecting means that the printing sheet is present, thereby to continue the printing operation.

According to the printer of the present invention, which has the above-described construction, the sheet feeding control means will further perform the sheet feeding in a predetermined quantity after data corresponding to one page has been printed. A detection is then made by the sheet detecting means as to whether or not the printing sheet exists in the vicinity of the printing means. If it is found that no printing sheet exists in the vicinity of the printing means, the printing control means makes a decision that no continuous-page sheet feeder has been mounted. On the other hand, if it is found that the printing sheet is present, the printing control means makes a decision that the continuous-page sheet feeder has been mounted. If it is found that no tractor feeder is mounted, the printing operation is stopped temporarily. If it is found that the tractor feeder has been mounted, the printing operation is continued.

In the above-described manner, the printer according to the present invention can determine whether or not the continuous-page sheet feeder is mounted on the body of the printer without providing a switch for detecting whether or not the continuous-page sheet feeder is present. The printing control is executed appropriately based on the result of such decision. Further, the increase in the number of components provided to detect whether or not the continuous-page sheet feeder is present can be avoided and manufacturing cost can be reduced.

The above and other objects, features and advantages of the present invention will become apparent from the following description and the appended claims, taken in conjunction with the accompanying drawings in which a preferred embodiment of the present invention is shown by way of illustrative example.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENT

Referring to FIGS. 1 through 4, a preferred embodiment of the invention will be described in detail.

Figure 1:
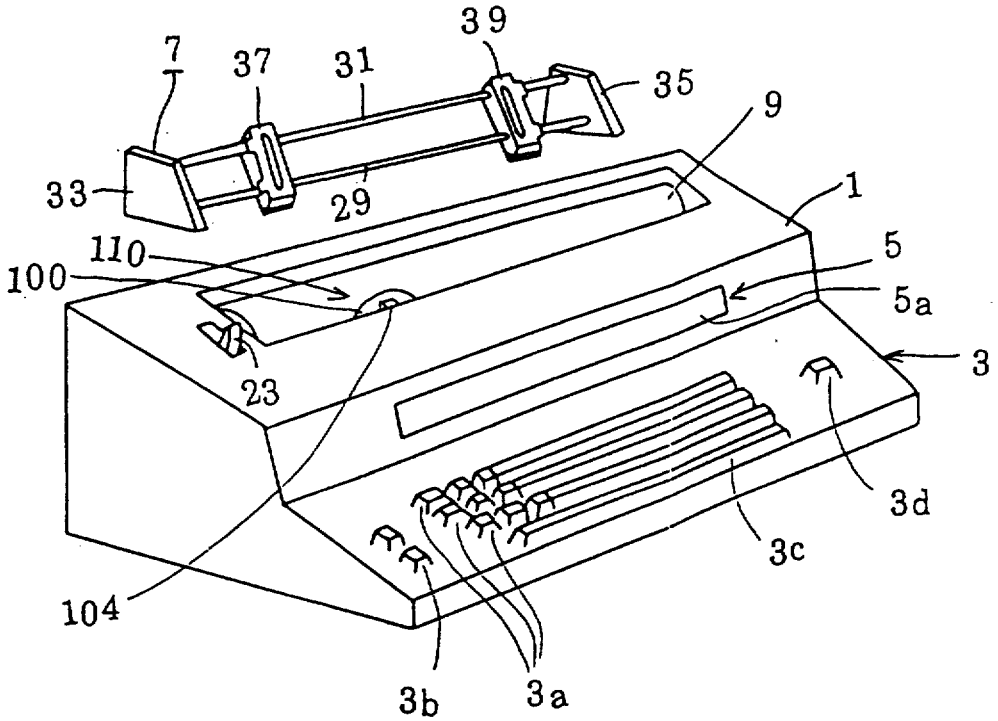
FIG. 1 is a perspective view showing the outline of a printer to which the present invention is applied and a tractor feeder for mounting thereon.

Referring first to FIG. 1, there is shown a typewriter having word processing capability, which incorporates a printer according to one embodiment of the invention for performing a printing operation based on a text data stored in a text memory 49*a* (which will be described).

The typewriter is provided with a keyboard 3 at its front, and a display 5 and a printing mechanism 14 disposed behind the keyboard 3.

The keyboard 3 has a multiplicity of character keys 3*a* for entering characters such as alphabetic letters, numerals and various symbols, and many function keys such as a printing key 3*b*, a space bar 3*c*, and a carriage return key 3*d*.

Figure 3:
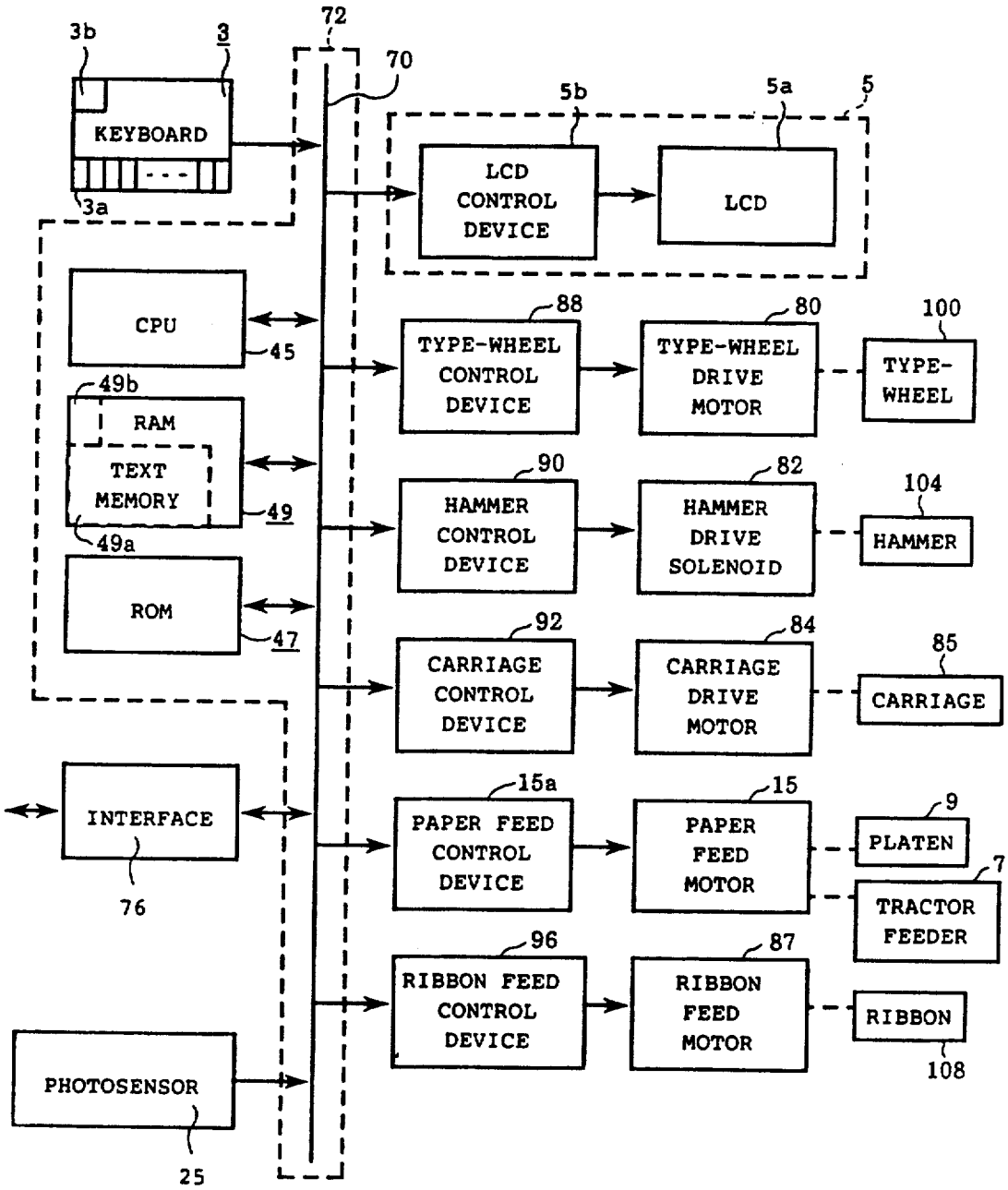
FIG. 3 is a block diagram illustrating the construction of a control unit for the printer.

The display 5 uses a liquid crystal display (LCD) 5*a*. As shown in FIGS. 1 and 3, this LCD 5*a* is connected to a LCD control device 5*b* which is operated under the control of a main controller 72. The main controller 72 incorporates a CPU 45 (central processing unit), a RAM 49 (random-access memory), a ROM 47 (read-only memory) and a data bus 70. The ROM 47 of the main controller 72 stores control programs for controlling the operation of the present typewriter.

The LCD 5*a* controlled by the LCD control device 5*b* is adapted to provide a menu which lists various modes of operation of the typewriter that are selectable by the operator through the keyboard 3. Further, the LCD 5*a* is adapted to display a portion of a text which is entered through the keyboard 3 and stored in the above indicated text memory 49*a* provided in the RAM 49. The LCD 5*a* also displays various messages from the typewriter to the operator. The RAM 49 is also used to store text data which are supplied from an external device through an interface 76.

The printing mechanism 14 has various drive sources including a type-wheel drive motor 80, a hammer drive solenoid 82, a carriage drive motor 84, a paper feed motor 15 and a ribbon feed motor 87.

These drive sources for the printing mechanism 14 are controlled according to control commands from main controller 72, via the corresponding control devices, i.e., a type-wheel control device 88, a hammer control device 90, a carriage control device 92, a paper feed control device 15*a* and a ribbon feed control device 96. Thus, the printing operation is effected. A type-wheel 100 shown in FIG. 1 is mounted on the output shaft of the type-wheel drive motor 80 mounted on a carriage 85.

The type-wheel 100 has 96 radial arms which carry at their ends respective type fonts. With the type-wheel drive motor 80 rotated by a suitable angle according to the text data, the type-wheel 100 is indexed to bring the desired one of the type fonts into the printing position aligned with a line of printing on a platen 9. A hammer 104 is provided on the carriage 85 such that the hammer 104 is disposed in front of the type font at the printing position. The hammer 104 is activated by the above-indicated hammer drive solenoid 82, thereby impacting the selected type font against a cut sheet 106 supported on the platen 9, via a ribbon 108 which is fed by the ribbon feed motor 87. In this way, the character corresponding to the impacted type font is printed on the sheet 106, as is well known in the art. The type-wheel drive motor 80, the type-wheel 100 and the hammer 104 cooperate with other elements to constitute a print head 110 which is mounted on the carriage 85. The carriage 85 is reciprocated along the axis of the platen 9 by the above-indicated carriage drive motor 84, whereby the print head 110 is moved right and left relative to the sheet 106, in the longitudinal direction of the platen 9. The sheet 106 is fed up and down with the platen 9 rotated by the paper feed motor 15. With the feeding movements of the sheet 106 and the print head 110, the printing position on the sheet 106 can be changed or shifted.

Figure 2:
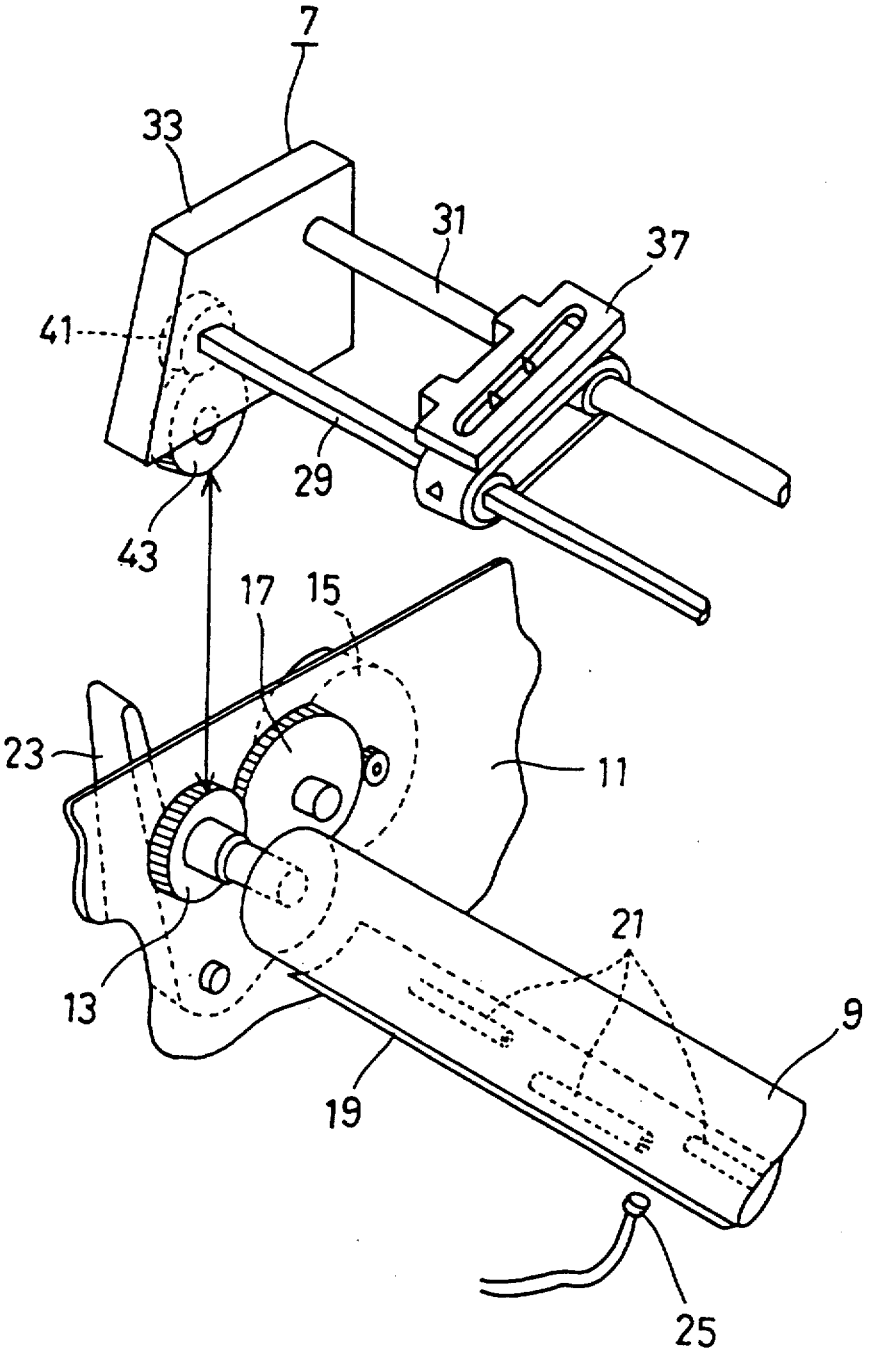
FIG. 2 is a partly perspective view depicting part of a mechanism of each of the printer and the tractor feeder.

A tractor feeder 7 (FIG. 2) used to continuously feed a continuous-page sheet is detachably mounted on this type of typewriter as a printer. The tractor feeder 7 is mounted upwardly of the platen 9 of the printing mechanism 14. As shown in FIG. 2, the platen 9 is rotatably supported on a frame 11 within the body of the typewriter and a rotary shaft for the platen 9 is provided with a gear 13. In addition, the gear 13 is interlocked with a rotary shaft of the paper feed motor 15 secured to the frame 11 via an intermediate gear 17 and the turning force produced by the paper feed motor 15 is transmitted to the platen 9. A paper pan !9, which is movable between a paper pressure position adjacent to the bottom face of the platen 9 and a paper release position distant from the bottom face of the platen 9, is provided at the bottom of the platen 9. A plurality of rollers 21, which are brought into contact with a printing sheet when the paper pan 19 is placed in the paper pressure position are rotatably supported in the paper pan 19. The paper pan 19 is interlocked with a release lever 23 by a known mechanism, and is also changed over to either one of the paper pressure position and the paper release position by controlling the release lever 23. In addition, the release lever 23 is controlled to change over the paper pan 19 to the paper release position with a view toward performing the feeding movement of the printing sheet only by the tractor feeder 7 when the tractor feeder 7 is mounted on the printing mechanism 14.

A photosensor 25 for sensing whether or not the printing sheet exists on the platen 9 is provided frontwardly of the bottom face of the platen 9. When photosensor 25 senses that the printing sheet does not exist on the platen 9, the CPU 45 controls the LCD control device **5*b* and a message for alarming the sheet absence or for urging an operator to insert the printing sheet, is displayed on the LCD 5*a***. Thus, the operator can know that a printing sheet is needed.

On the other hand, the tractor feeder 7 includes two parallel support shafts 29, 31 connectably supported between a pair of tractor frames 33 and 35, and two pin tractors 37, 39 mounted on the support shafts 29, 31. In addition, a gear portion 41 is provided at one end of one of the support shafts, i.e., the support shaft 29, and is brought into engagement with an interlocking gear 43 rotatably supported within the tractor frame 33. When the tractor feeder 7 is mounted on the printing mechanism 14, the interlocking gear 43 is maintained in engagement with the gear 13 provided on the side of the typewriter, and the rotational force of the motor 15 is transferred to the tractor feeder 7, whereby the pin tractors 37 and 39 are rotated.

Figure 4:
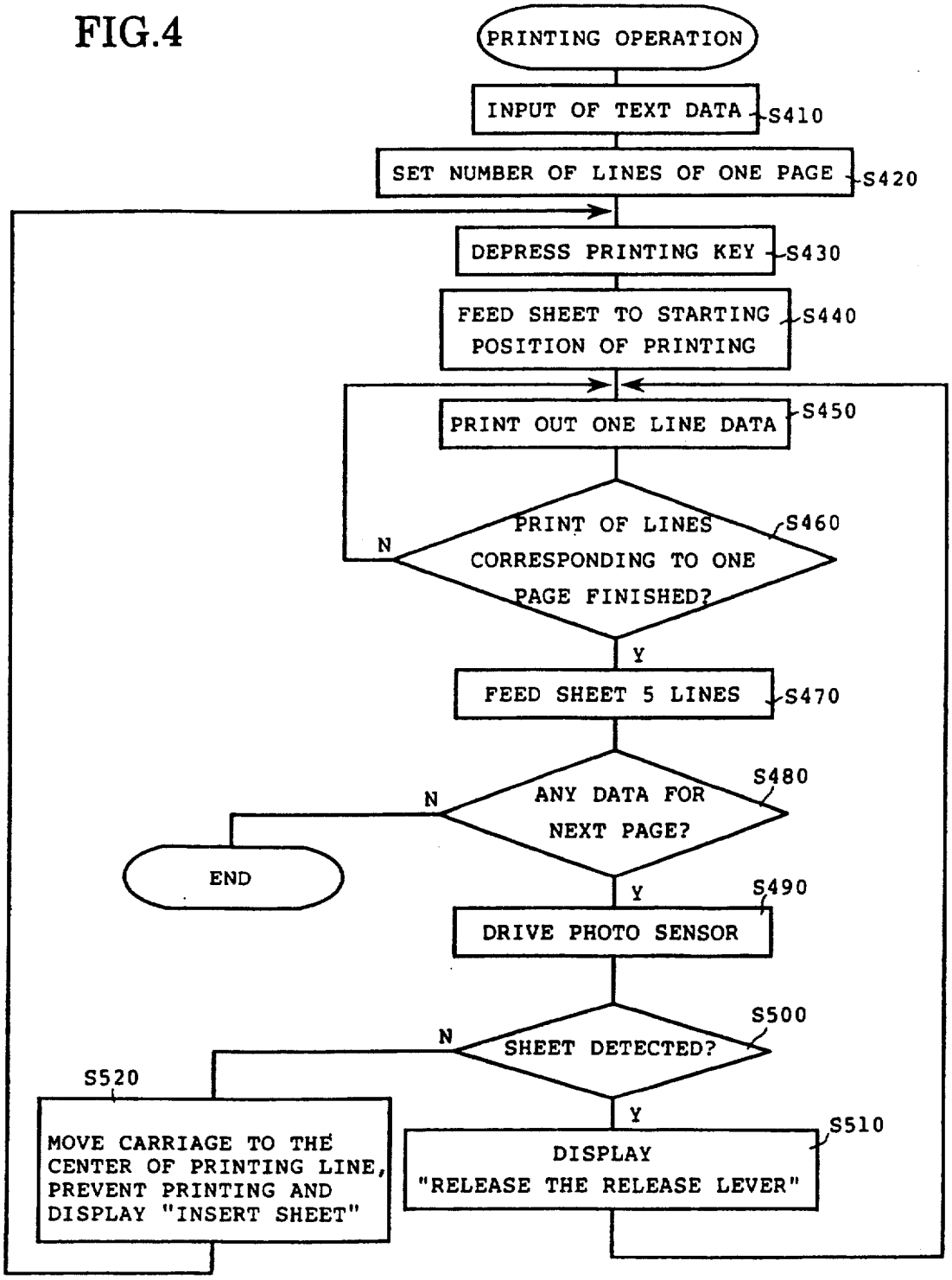
FIG. 4 is a flowchart for describing the operation of the printer.

The operation of the present invention will now be described with reference to FIG. 4.

It is first practiced in Step 410 (hereinafter abbreviated "S410" in the present description and the accompanying drawing) to input text data such as for example documents, etc. based on the control of the keyboard 3 by the operator. Next, in S420, the number of lines corresponding to one page to be printed is established by the control of the character keys **3*a* on the keyboard 3 performed by the operator, in view of the size of a cut sheet or the interval of perforations defined on the continuous-page sheet. The number of lines corresponding to one page to be printed is stored in a line memory 49*b*. The printing key 3*b* for making a start in the printing of the input text data is operated in S430. When a start in printing movement is made, the sheet feeding operation is executed up to a position where the printing is actually made on the printing sheet in S440. Then, the routine proceeds to S450. Data corresponding to one line which has not yet been printed is read out from the text data and the read data corresponding to one line is thereafter printed. Next, it is performed in S460 to judge whether or not the data corresponding to the number of lines to be printed, which has been established in S420 and stored in the line memory 49*b*, has been printed. If the judgment is no, the routine returns to S450. Then, S450 and S460 are repeatedly executed. If it is found to be yes in S460, the routine proceeds to S470. Here, the sheet feeding is made by a predetermined number of lines, e.g., five lines. As the result of this sheet feeding in S470, if the tractor feeder 7 has been mounted on the printer, the sheet feeding is made until a printing start position reaches a position to be printed. When the printed sheet is a cut sheet, a printed cut sheet is discharged from the printing mechanism 14. It is next judged in S480 whether or not data to be printed on the next page exists in the text memory 49*a*. If it is no, the routine is terminated. On the other hand, if it is yes, the routine proceeds to S490. The photosensor 25 is driven in S490. It is then performed in S500 to determine whether or not the photosensor 25 has detected a sheet for printing data corresponding to the following page. If it is yes, it is determined that the tractor 7 has been mounted, and hence the routine proceeds to S510. In order to cause the operator to shift the release lever 23 to a release position, a message "Release the release lever" is displayed on the LCD 5*a* in S510. Then, the routine returns to S450, and the printing operation is continued. If it is no in S500, it is judged that the tractor feeder 7 has not been mounted on the printer. The routine therefore proceeds to S520. In order to prevent the cut sheet from being inclined by interference between the left and right longitudinal edges thereof and the carriage 85 on the platen 9 when the cut sheet is inserted into the printing mechanism 14, the carriage 85 is controlled so as to be disposed in the center of a printing line width and the printing operation is prevented in S520. A message "Insert sheet" is displayed on the LCD 5*a*. At this time, the routine returns to S430. The operator can, however, supply the following cut sheet during stoppage of the printing operation. When the cut sheet is supplied by the operator and the printing key 3*a*** is operated by the operator again, a start in the printing operation is made.

Upon completion of the printing operation of one page in the above-described manner, the typewriter according to the present embodiment will automatically feed the sheet a predetermined number of lines. After feeding of the sheet, it is performed to determine whether or not the printing sheet for the following page is detected by the photosensor. Based on this detection result, a judgment is made as to whether or not the tractor feeder 7 has been mounted on the printer. According to a consequence of this judgement, the optimal printing control can be done correspondingly. Moreover it is unnecessary to provide a switch for detecting the tractor feeder 7, or the like. Accordingly, the increase in the number of components and that in the manufacturing cost can be avoided.

A description has been made on the typewriter in which the printer 1 is provided with the keyboard 3 in the present embodiment. The present invention can, however, be applied in the same manner even to a singly-provided printer used as a terminal device for the connection to a host computer, a word processor, etc.

Having now fully described the invention, it will be apparent to those skilled in the art that many changes and modifications can be made without departing from the spirit or scope of the invention as set forth herein.

We claim:

1. A printer adapted to have a continuous sheet feeder mounted thereon comprising:

a sheet feeder provided inside the body of the printer and for performing a cut sheet feeding;

a printing means for printing on a sheet;

a sheet feeding control means including means for controlling the driving of the continuous sheet feeder when mounted on the body of the printer and means for further performing additional sheet feeding of a predetermined amount after completion of the printing of data corresponding to one page on a printed sheet;

a sheet detecting means for detecting the presence of a subsequent sheet in the vicinity of the printing means after said additional sheet feeding has been performed; and a printing control means for controlling the printing means, said printing control means including means for determining the presence of the continuous sheet feeder on the printer in response to detection of a subsequent sheet by said sheet detecting means and for enabling continuation of the printing operation by said printing means in response to said determination of the presence of the continuous sheet feeder and means for preventing operation of the printing means in response to the determination of an absence of the continuous sheet feeder.

2. Apparatus as in claim 1, and further comprising:

means for removably mounting the continuous sheet feeder on the printer; and means for transmitting power to a continuous sheet feeder mounted on the printer.

3. A printer comprising:

a body;

an internal sheet feeder mounted inside the body, said internal sheet feeder having feeder drive means for performing cut sheet feeding;

a printing means for printing on a sheet;

a continuous-page sheet feeder for removable mounting on a body of the printer;

a power transfer means for transferring power from the feeder drive means to the continuous-page sheet feeder when mounted on the body of the printer;

a sheet feeding control means for controlling the feeder drive means to provide sheet feeding of a printed sheet by a predetermined amount after completion of the printing of data corresponding to one page;

a sheet detecting means for detecting the presence of a sheet in the vicinity of the printing means; and a printing control means adapted to determine the fact that no continuous-page sheet feeder has been mounted on the body of the printer if it is found by the sheet detecting means that no sheet is present in the vicinity of the printing means after said predetermined sheet feeding has been executed by the sheet feeding control means, thereby to stop the printing operation by the printing means, and also adapted to judge the fact that the continuous-page sheet feeder has been mounted thereon if it is found by the sheet detecting means that a subsequent sheet is present, thereby to continue the printing operation.

4. A printer comprising:

first means for feeding a cut sheet;

second means for feeding a continuous sheet;

means for printing on sheets fed by said first and second feeding means;

means for detecting the presence of either of a cut sheet and a continuous sheet in the vicinity of the printing means; and control means for stopping the printing means when a page of data is printed on either sheet by the printing means, said control means including means for initiating printing by the printing means of a next successive continuous sheet in response to detection of the presence of a continuous sheet in the vicinity of the printing means by the detecting means.

5. A printer as in claim 4, wherein the control means includes means for preventing operation of the printing means in the absence of detection of a sheet in the vicinity of the printing means by the detecting means.

6. Apparatus as in claim 4, wherein the control means includes means for feeding a sheet by a predetermined amount after said stoppage of printing by the printing means and means for determining a following continuous sheet is in the vicinity of the printing means when said detecting means detects the sheet after the feeding of the sheet just printed by the predetermined amount after said stoppage of printing by the printing means.

7. Apparatus as in claim 6, wherein the detecting means comprises an optical detector.

* * * * *